US010160617B2

(12) United States Patent
Beutler

(10) Patent No.: US 10,160,617 B2
(45) Date of Patent: Dec. 25, 2018

(54) BAG OPENER COMPONENT FOR PLASTIC BAG DISPENSER

(71) Applicant: Arthur J Beutler, Greendale, WI (US)

(72) Inventor: Arthur J Beutler, Greendale, WI (US)

( * ) Notice: Subject to any disclaimer, the term of this patent is extended or adjusted under 35 U.S.C. 154(b) by 565 days.

(21) Appl. No.: 14/756,067

(22) Filed: Jul. 27, 2015

(65) Prior Publication Data

US 2017/0029153 A1 Feb. 2, 2017

(51) Int. Cl.

| | |
|---|---|
| ***B65B 67/12*** | (2006.01) |
| ***B65H 35/10*** | (2006.01) |
| ***B65D 33/00*** | (2006.01) |
| *A47F 9/04* | (2006.01) |

(52) U.S. Cl.

CPC ..... *B65H 35/10* (2013.01); *B65D 33/002* (2013.01); *A47F 2009/044* (2013.01); *B65B 2067/1272* (2013.01); *B65H 2701/191* (2013.01)

(58) Field of Classification Search

CPC .. A47F 9/42; A47F 2009/044; B65B 67/1266; B65B 67/1277; B65B 2067/1272; B26F 3/002; B26F 3/02; A47K 2010/3863; B65H 35/10; B65H 2701/191

See application file for complete search history.

(56) References Cited

U.S. PATENT DOCUMENTS 2,874,886 A * 2/1959 Piazze ..... B65B 43/123 225/106
2,899,161 A * 8/1959 Bayard ..... B65B 43/26 248/101
3,313,504 A * 4/1967 Stoltze ..... B65B 67/12 206/283
3,481,112 A * 12/1969 Bourgeois ..... B65B 67/1266 220/495.07
3,605,376 A * 9/1971 Piazze ..... B65B 43/36 53/459
3,655,036 A * 4/1972 Corelli ..... B65B 67/1266 206/526
3,715,862 A * 2/1973 Schohl ..... B65B 67/1266 186/66
3,747,298 A * 7/1973 Lieberman ..... B65B 67/1266 248/100
3,861,125 A * 1/1975 Hagemeister ..... B65B 67/1266 248/99
4,723,743 A * 2/1988 Jenkins ..... B65B 67/12 220/486
4,750,694 A * 6/1988 Bateman ..... B65B 67/1266 248/175
4,793,539 A * 12/1988 Haenni ..... A47F 9/042 221/63
4,819,898 A * 4/1989 Benoit ..... B65B 43/14 248/97
4,840,335 A * 6/1989 Forman, Jr. ..... B65B 67/1227 248/97
4,840,336 A * 6/1989 Stroh ..... B65B 67/1227 248/175

(Continued)

*Primary Examiner* — Alexander Valvis
*Assistant Examiner* — Eduardo R Ferrero

(57) ABSTRACT

A bag opener is presented as an accessory component for bag roll dispensers, which allows bags to be dispensed to the user in a partially opened state. The opener may be extruded, molded or machined depending on the design of the dispenser, and is suitable for multiple-ply bags (such as "star sealed" bags) that are dispensed from a continuous roll.)

5 Claims, 6 Drawing Sheets

(56) References Cited

U.S. PATENT DOCUMENTS 4,904,092 A 2/1990 Campbell
4,930,385 A * 6/1990 Wilfong, Jr. ..... A47F 9/042 221/63
5,024,349 A * 6/1991 Haenni ..... A47F 13/085 221/197
5,087,234 A * 2/1992 Prader ..... A47F 9/042 206/554
5,135,146 A 8/1992 Simhaee
5,209,371 A * 5/1993 Daniels ..... A47F 13/085 221/63
5,261,585 A 11/1993 Simhaee
5,433,363 A 7/1995 Simhaee
5,480,084 A * 1/1996 Daniels ..... B26F 3/002 225/106
5,551,654 A * 9/1996 McNerney ..... B65B 67/1205 248/97
5,556,019 A 9/1996 Morris
5,558,262 A * 9/1996 Simhaee ..... B26F 3/002 225/106
5,573,168 A 11/1996 Kannankeril
5,641,138 A * 6/1997 Cronk ..... B65B 67/1233 242/597.8
5,706,993 A * 1/1998 DeMatteis ..... B26F 3/002 225/106
5,752,666 A 5/1998 Simhaee
5,921,390 A 7/1999 Simhaee
6,056,179 A * 5/2000 Muzquiz ..... B26F 3/002 225/106
6,065,272 A * 5/2000 Lecomte ..... B29C 65/222 53/459
6,086,022 A * 7/2000 Dalton ..... B65F 1/1415 248/101
6,135,281 A 10/2000 Simhaee
6,199,788 B1 * 3/2001 Simhaee ..... A47F 9/042 225/106
6,279,806 B1 * 8/2001 Simhaee ..... A47F 9/042 225/106
6,416,023 B1 * 7/2002 Satsky ..... B65B 67/12 248/99
6,450,380 B1 * 9/2002 Simhaee ..... A47F 9/042 221/26
6,488,242 B1 * 12/2002 Barriere ..... B65B 67/1233 248/100
6,679,462 B1 * 1/2004 Valdez ..... B65B 67/1211 248/101
6,705,575 B1 * 3/2004 Hoy ..... B65B 67/1233 248/97
6,932,257 B1 * 8/2005 Guerrero ..... B65H 35/10 225/39
7,270,256 B2 9/2007 Daniels
7,424,963 B2 9/2008 Daniels
7,604,143 B2 * 10/2009 Kerekes, Jr. ..... B65F 1/1415 141/114
8,770,454 B1 * 7/2014 Lutz ..... B65F 1/1615 224/260
8,875,968 B2 * 11/2014 Tan ..... B65H 35/10 225/10
8,888,054 B1 * 11/2014 Peterson ..... B62B 1/14 248/907
8,979,367 B2 3/2015 Tan
9,199,820 B2 * 12/2015 Tseng ..... B65H 35/10
9,206,007 B2 * 12/2015 Helseth ..... B65H 16/005
9,890,009 B1 * 2/2018 Chen ..... B26F 3/02
2003/0213804 A1 * 11/2003 Chomik ..... A47K 11/02 220/495.07
2004/0007607 A1 * 1/2004 Daniels ..... A47F 9/042 225/93
2004/0217122 A1 * 11/2004 Trinko ..... A47F 9/042 221/47
2005/0193691 A1 * 9/2005 Stravitz ..... B65B 9/15 53/567
2006/0102809 A1 * 5/2006 Broeders ..... B65B 67/1205 248/95
2009/0261106 A1 * 10/2009 Stelmach ..... B65F 1/06 220/495.11
2011/0073629 A1 * 3/2011 Tseng ..... B26F 3/02 225/51
2012/0024884 A1 * 2/2012 Wilfong ..... B65H 16/005 221/30
2012/0305618 A1 * 12/2012 Tan ..... B65H 35/10 225/47
2012/0325984 A1 * 12/2012 Moynihan ..... B65B 31/048 248/98
2013/0134181 A1 * 5/2013 Helseth ..... B65H 16/005 221/26
2014/0144966 A1 * 5/2014 Tan ..... B26F 3/02 225/47
2015/0144677 A1 * 5/2015 Tseng ..... B65H 35/10 225/106

* cited by examiner

*--Prior Art--*

--Prior Art--

--Prior Art--

--Prior Art--

BAG OPENER COMPONENT FOR PLASTIC BAG DISPENSER

STATEMENT REGARDING FEDERALLY SPONSORED RESEARCH OR DEVELOPMENT

Not applicable

FIELD OF THE INVENTION

This invention relates generally to devices that are designed to serially dispense plastic bags from a continuous roll, such as the type used for self-service produce, grocery or garbage bags. More specifically, this invention describes an accessory component that may be used to retrofit existing bag dispensers.

BACKGROUND OF THE INVENTION

Bag dispensers are ubiquitous throughout grocery stores and markets where produce and other items are displayed in bulk, and consumers select and bag their own merchandise for purchase. A common form of such dispensers utilizes rolls of bags, standardly referred to as "star-seal" bags, in which a tube of plastic is folded or gusseted to form multiple layers. The long tubes are welded laterally at uniform intervals to form individual bags. The bags are connected sequentially along perforated lines and wound onto a roll. A projection on the dispenser, hereinafter referred to as the tongue, engages a slot in the perforation line to separate a bag from the roll and hold the trailing bag in position for the next user.

A common complaint of users is that, once a bag has been removed, it is difficult to open. This is partially due to the bag material,-which has a tendency to build up a static charge causing the thin layers of plastic to adhere to each other. However, it is also a deficiency of current dispenser designs that they do not provide a means for separating the plies as the bags are dispensed.

Multiple dispenser designs have been disclosed in prior art that address a variety of issues related to the utility of bag dispenser devices. Simhaee (U.S. Pat. Nos. 5,135,146, 5,261,585, 5,433,363) describes various features to enable one-handed operation and prevent free-wheeling of the roll during operation. In later designs, Simhaee (U.S. Pat. No. 5,752,666) incorporates an additional mechanism which traps the leading edge of the next bag to prevent dispensing more than one bag at a time. Morris (U.S. Pat. No. 5,556, 019) introduced a design that allows for operation when bags are pulled across the top or bottom of the tongue, and also incorporates a means of providing constant tension on the bags regardless of how many remain on the roll.

Kannankeril (U.S. Pat. No. 5,573,168) discloses a dispenser with a guide slot to ensure more reliable contact between the perforation and the tongue. The invention also discloses a "brush" as a frictional element to assist in opening the bags, however, this mechanism is integrated into an interior panel and is therefore limited to use with the described dispenser design. Kannankeril's design also differs from the present invention in that the frictional element engages the top ply of the bag rather than the bottom ply as disclosed in the present invention. Applying friction to the top ply, as Kannankeril describes, requires the user to pull upward on the bag in order to achieve adequate frictional force to seperate the bag plies. This design also applies friction prior to separation of the leading bag from the trailing bag. In order to separate the plies as a bag is dispensed, the frictional element must be positioned such that the friction is applied while the bags are being separated at the perforation line.

Daniels (U.S. Pat. Nos. 7,270,256 and 7,424,963) discloses a bag opening means that is also integrated into the dispenser and thus is limited to use with the described dispenser design. The bag opening means is also designed to facilitate opening of the leading bag as opposed to the trailing bag, as described in the present invention.

Other inventions specifically aimed at facilitating opening of bags as they are dispensed address this issue by modifying the design of the bag itself. Simhaee (U.S. Pat. No. 6,135, 281) describes a method of manufacturing a continuous strip of in which one or more Outer layers are separated entirely at the perforation line to facilitate easier separation of the bag from the roll. In another invention, Simhaee (U.S. Pat. No. 5,291,390) describes a bag design in which one ply does not contain a slit along the perforation line. The extra force required to detach this ply from the roll causes the plies to separate from each other. Campbell (U.S. Pat. No. 4,904, 092) discloses the use of pressure sensitive adhesive on an outer surface of each bag which causes the front and back to separate when another is pulled from the roll or stack. Finally, Tan (U.S. Pat. No. 8,979,367) discloses features on the outer surface of the bags (either in a roll or in a stack) which releasably attach the rear wall of a first bag to the front wall of a second bag so that when the first bag is removed it causes the second bag to open before releasing. All of these solutions add extra cost to the individual bags, generating ongoing and unnecessary expense for the consumer.

In light of the foregoing discussion, it is an objective of the present invention to provide a means of dispensing plastic bags from a roll such that the bags are presented to the user in a partially opened state, without the need for specially modified bags.

Furthermore, it is an objective of the present invention to do so by providing an inexpensive accessory that can be easily retrofitted to a variety of existing plastic bag roll dispensers without the need for special tools or other apparatus.

SUMMARY OF THE INVENTION

The present invention describes a device that may be fitted to existing plastic bag dispensers —in particular those that utilize rolls of bags standardly referred to as "star seal"—such that the bags are dispensed in such a way that bags are presented to a user in a partially opened state. The device comprises a frictional top surface and a means of attachment to bag dispensers of various designs.

In a preferred embodiment, this device comprises a length of high-friction, pliable material that is extruded to conform to the top surface of a bag dispenser element, such material having sufficient coefficient of friction so as to exert adequate friction force against the bag to separate the plies, yet possessing adequate rigidity so as to be durable and robust.

In another embodiment, this device comprises a housing made of high-friction, pliable material that conforms to the top surface and encloses multiple sides of a bag dispenser element, such material having sufficient coefficient of friction so as to exert adequate friction force against the bag to separate the plies, yet possessing adequate rigidity so as to be durable and robust.

In another embodiment, this device comprises a length of high-friction, pliable material that is attached to a bag dispenser element by other mechanical means.

DETAILED DESCRIPTION OF THE INVENTION

Referring to FIGS. 1-5*b*, the bag opener component of the present invention includes a friction element and a means of mounting to an existing bag roll dispenser in such a way as to enable bags to be presented in a partially opened state.

Figure 1:
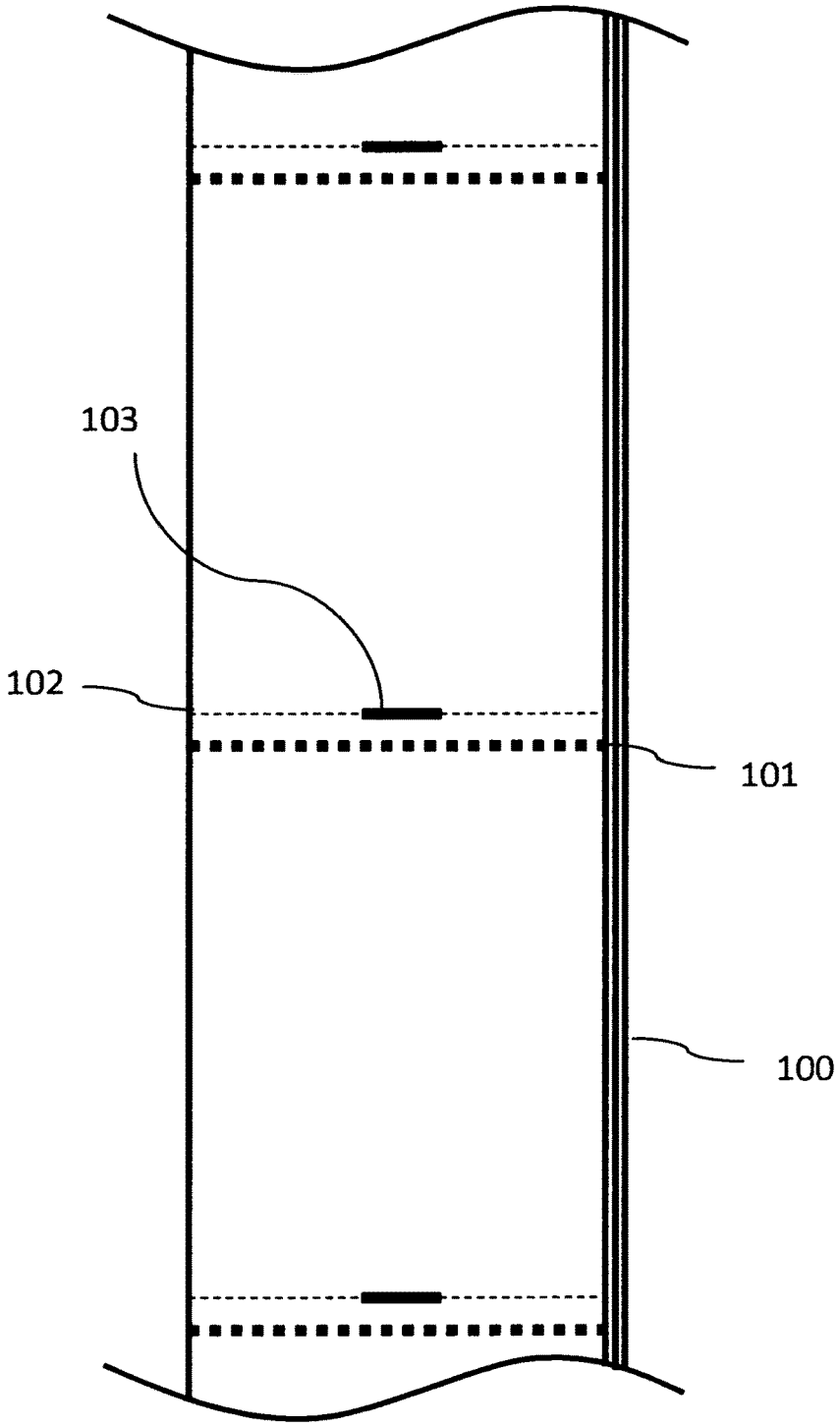
FIG. 1 illustrates typical construction of plastic bags that are dispensed from a continuous roll.

FIG. 1 illustrates a typical bag design of the type standardly referred to as "star seal." The bag 100 is formed from a tube of thin film plastic that is folded or gusseted creating multiple bag plies. Each bag is welded at one end 101 to form the bag bottom and releasably attached to the next bag by means of a perforation line 102. A slot 103 in the perforation line provides an opening to facilitate separation. A continuous strip of bags is wound on a roll for dispensing in a bag dispenser.

Figure 2:
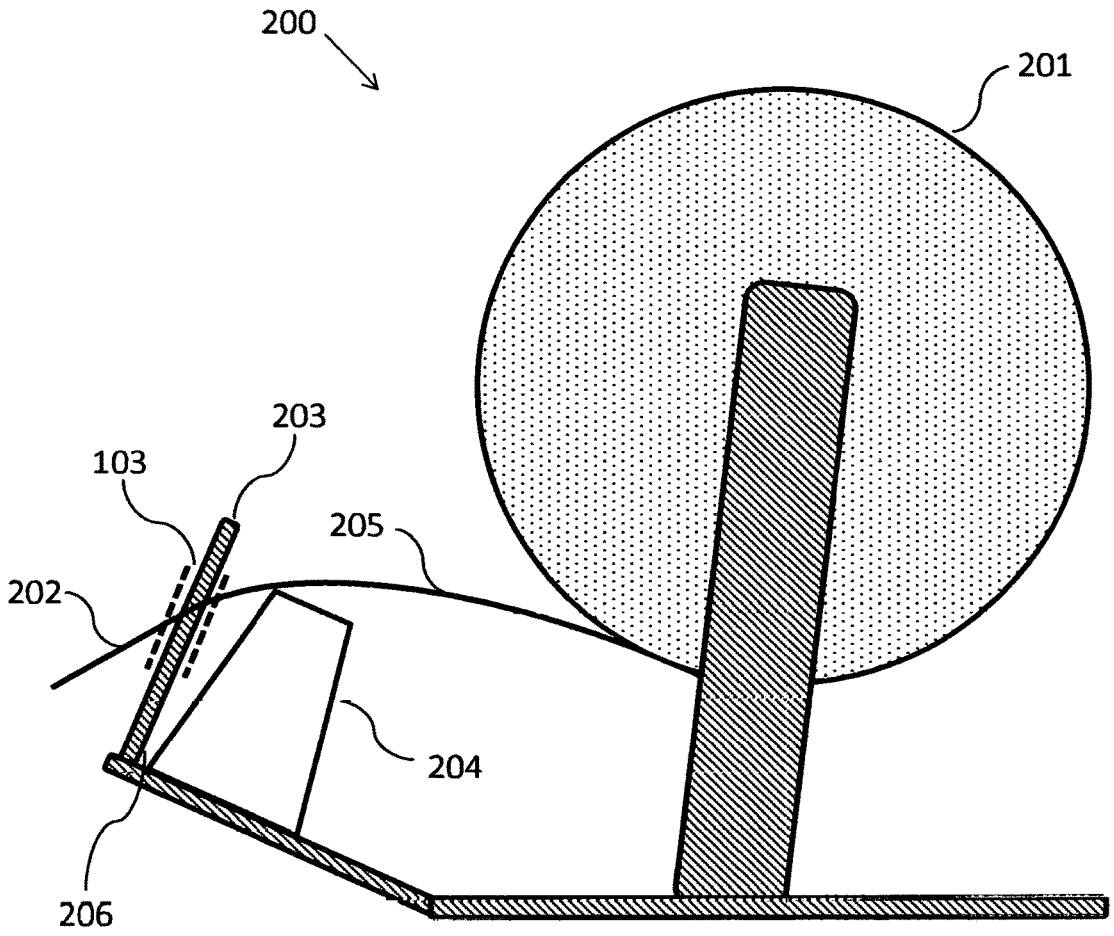
FIG. 2 illustrates a typical bag dispenser.

FIG. 2 is a functional illustration of a typical bag dispenser 200 for a roll of bags 201 constructed as described above. As a single bag 202 is dispensed, a tongue 203 engages a slot 103 in the perforation line between the bag being dispensed 202 and the trailing bag 205. A finger 204 creates a gap 206 which traps the leading edge of the trailing bag 205 and holds it in position for the next user.

Figure 3A:
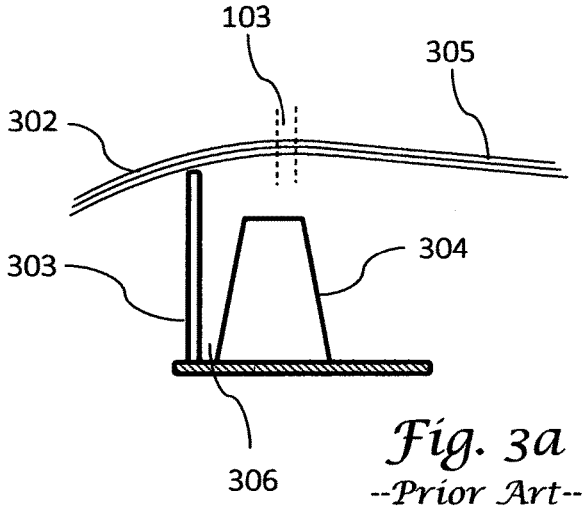
FIGS. 3*a*, 3*b* and 3*c* illustrate the operation of a common type of metal frame bag dispenser.
Figure 3B:
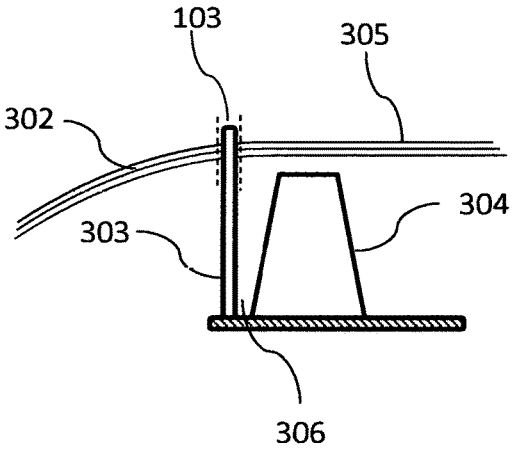
Figure 3C:
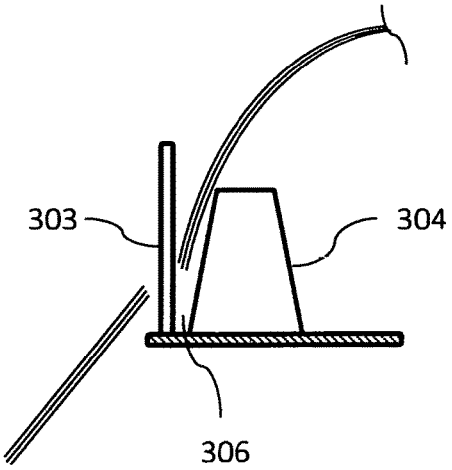

FIGS. 3*a*, 3*b*, and 3*c*, illustrate this action in greater detail for multi-ply bags that would be typical of a star-seal design. As shown in FIG. 3*a*, as the leading bag 302 is being dispensed, it rides smoothly along the top of the tongue 303. When the tongue 303 engages the slot 103 in the perforation line between the leading bag 302 and the trailing bag 305, as illustrated in FIG. 3*b*, it limits further travel of the trailing bag 305 and facilitates separation of the two bags along the perforation line. As shown in FIG. 3*c*, as the bags are being separated, the leading edge of the trailing bag 305 is pulled into the gap 306 that is formed between the tongue 303 and the finger 304. Due to the fact that the finger 304 is a smooth surface, the trailing bag 305 rides smoothly over the surface and the bag plies do not separate.

Figure 4A:
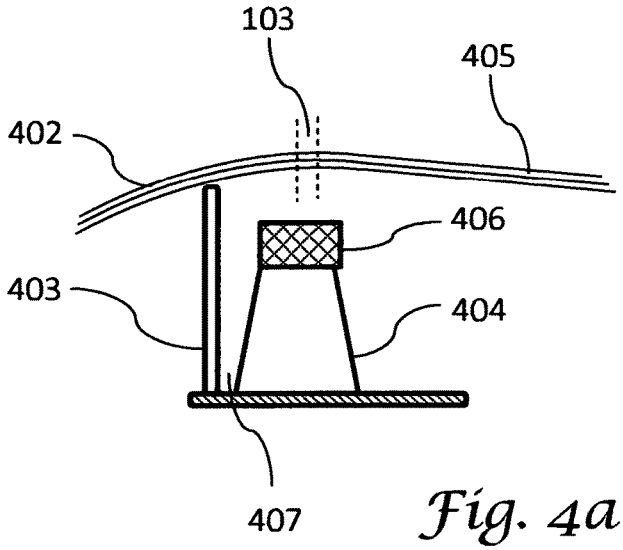
FIGS. 4*a*, 4*b* and 4*c* illustrate the operation of a common type of metal frame bag dispenser with a preferred embodiment of the present invention attached.
Figure 4B:
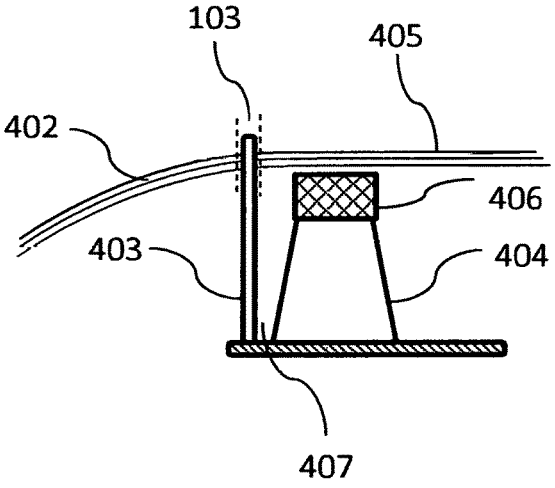
Figure 4C:
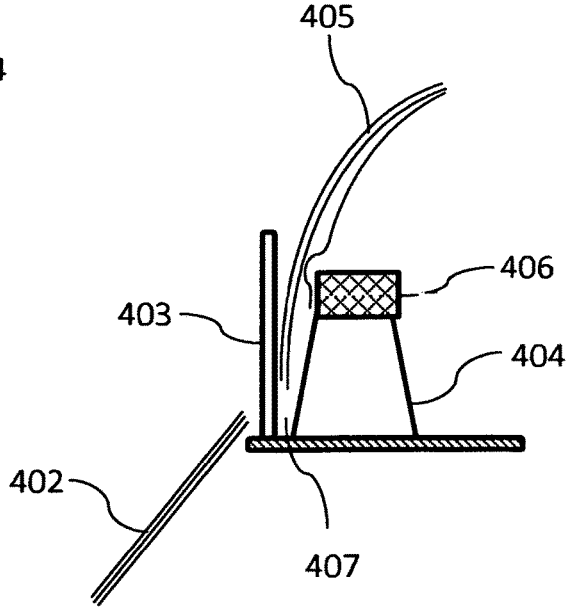

FIGS. 4*a*, 4*b* and 4*c* illustrate this same action with the bag opener component 406 of the present invention attached to the finger 404 of a typical dispenser. As shown in FIG. 4*a*, as the leading bag 402 is being dispensed, it rides smoothly along the top of the tongue. When the tongue engages the slot 103 in the perforation line between the leading bag 402 and the trailing bag 405, as illustrated in FIG. 4*b*, it limits further travel of the trailing bag 405 and facilitates separation of the two bags along the perforation line. However, in this case, the trailing bag 405 encounters the frictional surface of the bag opener 406 of the present invention. As shown in FIG. 4*c*, as the bags are being separated, and the leading edge of the trailing bag 405 is pulled into the gap 407 that is formed between the tongue 403 and the finger 404, friction applied against the bottom ply of the trailing bag 405 causes the plies to separate, leaving the trailing bag 405 in a partially opened state for the next user.

Figure 5A:
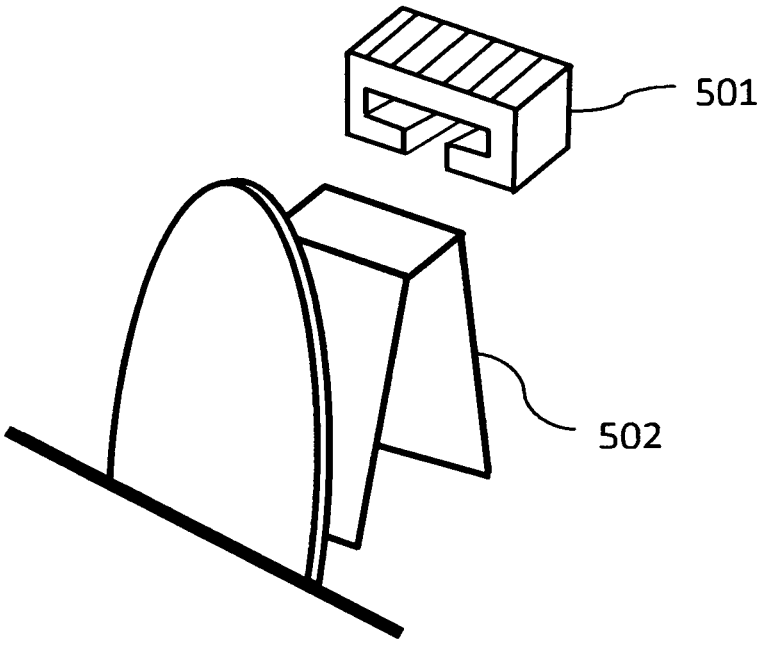
FIG. 5*a* is an exploded view of a preferred embodiment of the present invention and the dispenser component to which it attaches.

FIG. 5*a* is an exploded view of a preferred embodiment of the present invention, which is designed for use on dispensers having a finger 502 that is open on both sides, such as a metal frame bag dispenser. The bag opener component 501 may be constructed as a single piece by the extrusion method. The component material is selected to provide adequate frictional force to separate the lower bag ply from the upper bag plies. The material must be sufficiently pliable to conform to the finger 502 element of the dispenser, while having adequate wall strength to hold it securely in position possess Suitable materials include but are not limited to silicone, natural rubber, polyethylene and polyurethane.

Figure 5B:
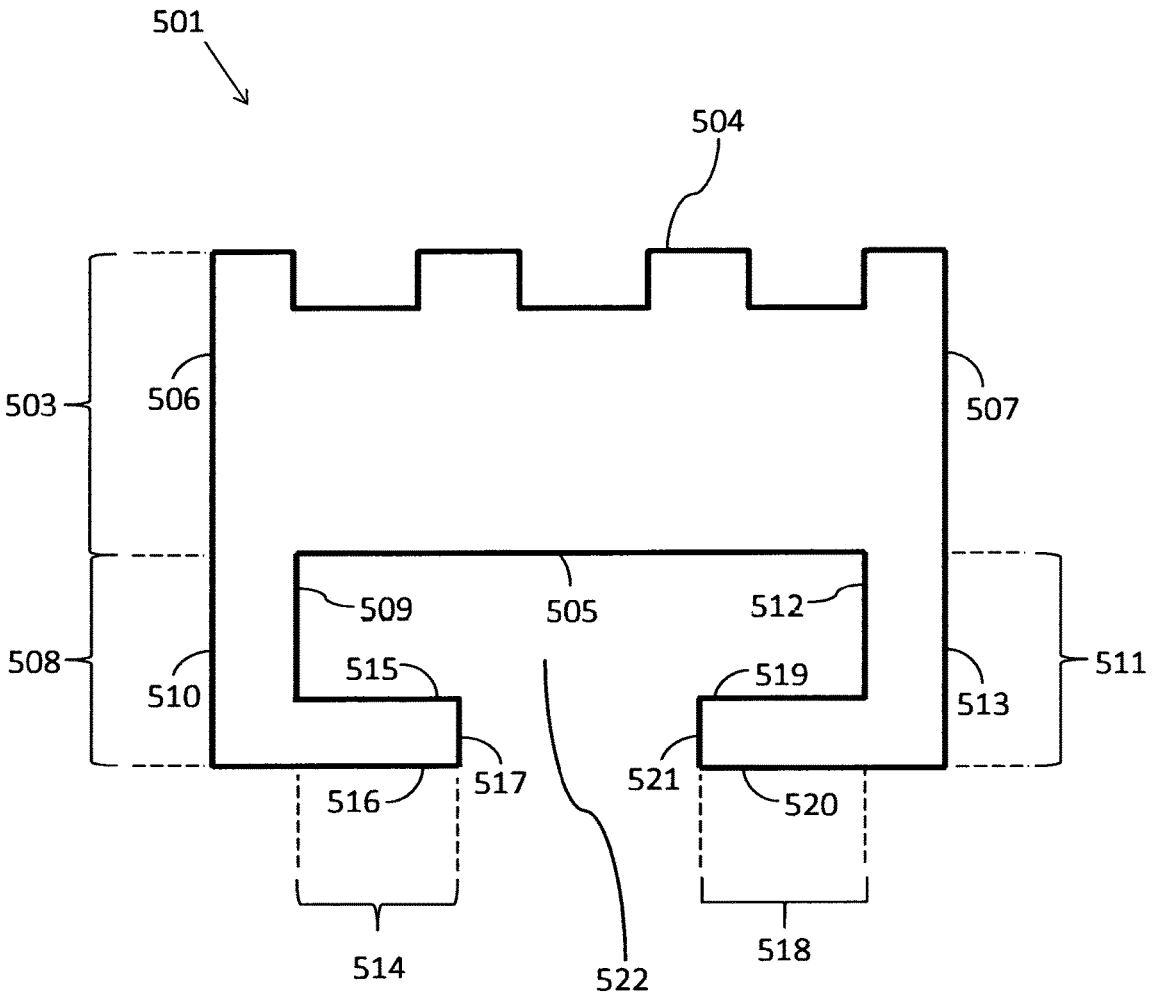
FIG. 5*b* is a cross-sectional view of a preferred embodiment of the present invention.

FIG. 5*b* is a cross-sectional view of the bag opener component of the present invention. The top 503 portion of the bag opener component comprises an outer surface 504, an inner surface 505, a first end 506 and a second end 507. The overall height, width and depth of the top 503 may be varied to fit the dimension of varying existing bag dispenser fingers 502. The top outer surface 504 is comprised of a friction inducing material that is capable of separating the lower bag ply from the upper bag plies. Suitable materials include but are not limited to grit paper, silicone, natural rubber, polyethylene and polyurethane. As shown in FIG. 5*b* the top outer surface 504 of the bag opener component 501 may incorporate a series of ridges, grooves or other protuberances to enhance the friction characteristics required to separate the lower bag ply from the upper bag plies.

A first side 508 extending generally orthogonal to the top inner surface 505 and adjoining the first end 506 comprises a first side inner surface 509 and a first side surface 510. A second side 511 extending generally orthogonal to the top inner surface 505 and adjoining the second end 507 comprises a second side inner surface 512 and a second side outer surface 513.

A first bottom flange 514 extending generally orthogonal to the first side inner surface 509 and generally parallel to the top inner surface 505 comprises a first bottom flange inner surface 515, a first bottom flange outer surface 516 and a first bottom flange end 517. A second bottom flange 518 extending generally orthogonal to the second side inner surface 512 and generally parallel to the top inner surface 505 comprises a second bottom flange inner surface 519, a second bottom flange outer surface 520 and a second bottom flange end 521.

The dimensions of the aperture 522 are defined by the boundary of the first flange inner surface 515, the first side inner surface 509, the top inner surface 505, the second side inner surface 512 and the second flange inner surface 519, and may be adjusted to fit varying dimensions of existing bag dispenser fingers 502. The separation between the first bottom flange end 517 and the second bottom flange end 521 facilitates installation of the bag opener component over existing bag dispenser fingers 502.

As described herein, the present invention provides an accessory and adaptor for existing bag roll dispensers that enables plastic bags to be dispensed from a roll in a partially opened state.

The foregoing description was primarily directed to a preferred embodiment of the invention. It is anticipated that one skilled in the art will likely realize additional alternatives that are now apparent from disclosure of the embodiments of the invention.

What is claimed:

1. An accessory component for retrofitting a bag roll dispenser to facilitate the dispensing of bags from a continuous roll in a partially opened state, the bag roll dispenser comprising: a top having an outer surface, an inner surface, a first end and a second end; a first side extending generally orthogonal to the top inner surface adjoining the top first end and having a first inner side surface and a first outer side surface; a second side extending generally orthogonal to the top inner surface adjoining the top second end and having a second inner side surface and second outer side surface; a first bottom flange extending generally orthogonal to the first side inner surface in a direction generally parallel to the top inner surface having a first bottom flange inner surface and first bottom flange outer surface and terminating at a first bottom flange end; a second bottom flange extending generally orthogonal to the second side inner surface in a direction generally parallel to the top inner surface having a second bottom inner flange surface and a second bottom outer flange surface and terminating at a second bottom flange end; wherein the first bottom flange and the second bottom flange extend in a direction generally toward one another; wherein the bag roll dispenser comprises a tongue configured to separate a bag from the roll and a finger; wherein the accessory component attaches to the finger by means of an aperture on the accessory component that is sized to match openings on two sides of the finger; wherein the aperture is defined by the boundary of the first bottom flange inner surface, the first side inner surface, the top inner surface, the second side inner surface, and the second bottom flange inner surface, and; wherein at least the top outer surface is constructed from a friction inducing material, whereby said friction inducing material provides sufficient resistance to the bottom ply of a multiply bag in order to separate the plies as a bag is dispensed.

2. The accessory component of claim 1 wherein the friction inducing material is one of silicone, rubber, polyethylene or polyurethane.

3. The accessory component of claim 1 wherein the entire component is comprised of friction creating material.

4. The accessory component of claim 3 wherein the friction inducing material is one of silicone, rubber, polyethylene or polyurethane.

5. The accessory component of claim 1 wherein the top outer surface includes grooves, ridges or other protuberances.

* * * * *